US011339705B2

(12) United States Patent
Turoczy et al.

(10) Patent No.: US 11,339,705 B2
(45) Date of Patent: May 24, 2022

(54) ADJUSTABLE MOUNTING FOR EXHAUST TREATMENT COMPONENT

(71) Applicant: Perkins Engines Company Limited, Peterborough (GB)

(72) Inventors: Arpad Turoczy, Peterborough (GB); Naseer Niaz, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 16/963,069

(22) PCT Filed: Jan. 29, 2019

(86) PCT No.: PCT/EP2019/025027
§ 371 (c)(1),
(2) Date: Jul. 17, 2020

(87) PCT Pub. No.: WO2019/149449
PCT Pub. Date: Aug. 8, 2019

(65) Prior Publication Data

US 2020/0347772 A1 Nov. 5, 2020

(30) Foreign Application Priority Data

Jan. 31, 2018 (GB) ..... 1801606

(51) Int. Cl.
*F01N 13/18* (2010.01)
*F01N 3/20* (2006.01)

(52) U.S. Cl.
CPC ..... *F01N 13/1822* (2013.01); *F01N 13/1855* (2013.01); *F01N 3/2066* (2013.01);
(Continued)

(58) Field of Classification Search
CPC ..... F01N 13/1805; F01N 13/1855; F01N 13/1822; F01N 13/1844; F01N 2450/24; F16B 2/08; B23K 37/0533; F16L 3/1075
See application file for complete search history.

(56) References Cited

U.S. PATENT DOCUMENTS 5,007,768 A 4/1991 Waller
5,251,439 A * 10/1993 Nakase ..... F01N 13/12 60/310

(Continued)

FOREIGN PATENT DOCUMENTS

CN 203823287 9/2014
DE 202012100235 U1 4/2013

(Continued)

OTHER PUBLICATIONS

International Search Report for related International Application No. PCT/EP2019/025027; dated Mar. 29, 2019.

(Continued)

*Primary Examiner* — Anthony Ayala Delgado

(57) ABSTRACT

An exhaust treatment component may be mounted in brackets, each bracket having a clamping surface which in a use orientation is arranged in parallel with a corresponding mounting surface of a fixed mount, the mounting surfaces defining adjustment planes which are spaced apart along a length axis of the mount. Each bracket may be adjusted independently in its use orientation to define a variable clamping position in the adjustment plane. In another aspect, the component may be mounted in one or more brackets, each bracket comprising curved contact surface, each surface being defined by an arc of a respective circle, each arc being contained in the circle of the other respective arc, whereby the centre points of the respective circles are spaced apart in the reference plane so that each arc is (Continued)

contained in the circle of the other respective arc. The component can be clamped to the bracket irrespective of its diameter.

8 Claims, 8 Drawing Sheets

(52) U.S. Cl.
CPC ..... *F01N 2340/04* (2013.01); *F01N 2450/24* (2013.01); *F01N 2450/30* (2013.01)

(56) References Cited

U.S. PATENT DOCUMENTS 6,059,252 A * 5/2000 Emmann ..... B60K 15/067 248/503
6,402,198 B2 * 6/2002 Gollungberg ..... B60K 15/067 280/830
8,820,691 B2 9/2014 Bednarz et al.
9,139,232 B1 * 9/2015 De La rosa ..... B62D 49/00
9,175,455 B2 * 11/2015 Sakai ..... F01N 13/1805
9,347,362 B2 5/2016 Harrington et al.
9,869,229 B2 * 1/2018 Novacek ..... F01N 13/1805
2008/0061487 A1 3/2008 Falk
2010/0186394 A1 * 7/2010 Harrison ..... F01N 3/2882 60/299
2011/0053444 A1 3/2011 Benedetti
2011/0167808 A1 * 7/2011 Kosaka ..... F01N 13/1894 60/311
2011/0215220 A1 9/2011 Loebig
2012/0011833 A1 * 1/2012 Kamei ..... E02F 9/0866 60/297
2012/0012731 A1 * 1/2012 Johnson ..... F01N 13/1822 248/638
2013/0013268 A1 * 1/2013 Woolf ..... G06F 17/00 703/1
2013/0305688 A1 11/2013 Kosaka et al.
2015/0217634 A1 * 8/2015 Sawai ..... F01N 3/021 280/834
2015/0275476 A1 * 10/2015 Sakai ..... F01N 13/009 172/701.1
2015/0292535 A1 * 10/2015 Albin ..... B25B 5/068 24/70 ST
2016/0053661 A1 * 2/2016 Freeman ..... F01N 3/2066 60/301
2016/0061090 A1 * 3/2016 Anand ..... F01N 3/035 60/297
2016/0076430 A1 * 3/2016 Freeman ..... F01N 13/1844 60/301
2016/0082829 A1 * 3/2016 Hummel ..... F16B 2/08 248/315
2017/0009638 A1 * 1/2017 Suetou ..... F01N 13/18
2020/0347772 A1 * 11/2020 Turoczy ..... F01N 13/1822

FOREIGN PATENT DOCUMENTS

EP 1645790 4/2006
EP 2345802 A2 7/2011
EP 2984313 B1 2/2018
FR 2701070 A1 8/1994
GB 2445681 A 7/2008
GB 2518562 A 3/2015
JP H05-336636 A 12/1993
JP 2011163339 8/2011
JP 2014-080998 A 5/2014
KR 2003-93143 Y1 8/2005

OTHER PUBLICATIONS

Great Britain Search Report for related GB Application No. GB 1801606.3; dated Jul. 27, 2018.
Great Britain Search Report for related GB Application No. GB 1801606.3; dated May 28, 2020.

* cited by examiner

ADJUSTABLE MOUNTING FOR EXHAUST TREATMENT COMPONENT

CROSS-REFERENCE TO RELATED APPLICATION

This Application is a 35 USC § 371 US National Stage filing of International Application No. PCT/EP2019/025027 filed on Jan. 29, 2019 which claims priority under the Paris Convention to Great Britain Patent Application No. 1801606.3 filed on Jan. 31, 2018.

TECHNICAL FIELD

The present disclosure relates to systems for adjustably mounting components of an exhaust treatment system, for example, on an internal combustion engine.

BACKGROUND

Exhaust treatment components may comprise for example particulate filters, catalytic converters, and other elements through which exhaust gas is arranged to flow before being discharged to atmosphere. Such components often comprise a generally cylindrical housing, often referred to as a can, which forms a flowpath for the exhaust gas. A block of porous ceramic or other filter material may be arranged in the housing, which may be inwardly compressed to retain the block in position when the assembly is in motion, for example when attached to a vehicle engine, and to form a seal around the block so that the exhaust gas is forced to flow through the block along the length axis of the housing.

Often such blocks are of variable dimensions, even when produced under highly repeatable conditions, and so it is necessary to compress the housing to an indeterminate diameter to suit the exact dimensions of the block positioned inside the housing. Thus, the outer dimensions of individual housings may vary within a range of several millimetres.

The housing will usually include inlet and outlet connections which may be connected to upstream and downstream components of the exhaust treatment system. For example, where the housing is mounted on an internal combustion engine, the inlet connection may be connected to the outlet of a turbocharger, and the outlet to another, similar downstream treatment component.

Since the engine and other component specifications may vary from one engine build to another, and since in addition each component of the engine and exhaust gas treatment system is subject to manufacturing tolerances, it is often necessary to use flexible or adjustable fluid connectors in order to achieve a gas and pressure tight seal between adjacent components while compensating for slight misalignment between the components when they are fixed in position on the engine. Such connectors however increase the cost and overall dimensions of the assembly.

It is known to provide an adjustable mounting so that the position of each component can be varied to align the inlet and outlet connections correctly.

KR 200393143 Y1 for example discloses a mounting system for an exhaust treatment component, comprising a fixed vertical bracket and an arm extending horizontally from the bracket. The arm is positionally adjustable along the vertical direction of the bracket. A clamp for the exhaust component is connected to the arm and positionally adjustable along the horizontal direction of the arm.

U.S. Pat. No. 9,347,362 B2 discloses a mounting system for an exhaust treatment component, comprising two or more independently detachable brackets, each bracket having a mounting strap. The component is secured to the brackets by the straps.

Without using a flexible or adjustable fluid connector however it is often difficult to achieve satisfactory fluid connections between exhaust system components, particularly when they exhibit substantial dimensional tolerances, even when the components are mounted using an adjustable mounting system.

SUMMARY

In a first aspect the present disclosure presents an assembly, and in a second aspect a mounting bracket, as defined in the claims.

The assembly and the mounting bracket are used for mounting a component of an exhaust treatment system to a support surface.

In the first aspect, the assembly includes a mount which is attachable to the support surface, together with at least two brackets and at least two bracket fixings. The mount defines at least two, substantially parallel mounting surfaces which are spaced apart along a length axis of the mount, each mounting surface extending in a respective adjustment plane substantially normal to the length axis. In use, each bracket is arranged in a use orientation with a clamping surface of the bracket in opposed relation to a respective one of the mounting surfaces. The brackets are configured for attachment of the component to all of the brackets in a use position wherein the component extends along the length axis. Each bracket is independently adjustable in its use orientation to define a selected clamping position which is variable in any direction in the respective adjustment plane. Each bracket fixing is operable to operatively engage the clamping surface of the respective bracket with the opposed mounting surface to fix the bracket to the mount in the selected clamping position.

Each bracket fixing may be arranged to be accessible and operable when the component is attached to all of the brackets in its use position.

In the second aspect, when considered in a reference plane passing through the bracket, the mounting bracket comprises two curved contact surfaces which are arranged to engage a curved outer surface of the component in its use position. Each contact surface defines an arc of a respective circle spaced by a radius from a respective centre point, the centre points of the respective circles being spaced apart in the reference plane so that each arc is contained in the circle of the other respective arc.

Two or more of the mounting brackets in accordance with the second aspect of the disclosure may form part of the assembly of the first aspect of the disclosure, in which case the reference plane will be substantially parallel with the respective adjustment plane. In the second aspect of the disclosure, the mounting bracket may also be used in other applications to mount a component of an exhaust treatment system directly on indirectly to a support surface. In the first aspect of the disclosure, the brackets may be arranged without the curved contact surfaces to suit the shape of the component.

In embodiments, the radius of each respective circle may be from 95% to 105% of the radius of the other respective circle, the centre points optionally being spaced apart by a distance not less than 8% and not more than 13% of the radius of each of the circles.

In embodiments, when considered in the reference plane, the contact surfaces may form opposite sides of a recess bounded by an open side through which in use the component may be introduced into the recess, the open side being defined as a straight line at which both contact surfaces terminate, wherein the centre points are spaced apart along a straight reference line collinear or substantially parallel with the open side. The reference line may be arranged outwardly of the recess with respect to the open side. The reference line and the open side may be spaced apart by a distance of not more than 4% of the radius of each of the circles.

BRIEF DESCRIPTION OF THE DRAWINGS

Further features and advantages will be evident from the following illustrative embodiment which will now be described, purely by way of example and without limitation to the scope of the claims, and with reference to the accompanying drawings, in which:

FIGS. 15 and 18 are left side views of the bracket wherein inner and outer, concentric circles represent the maximum and minimum diameter of the component in the reference plane at the extremities of its range of dimensional variation, wherein:

FIG. 15 shows the use position of the component when its diameter indicated by the solid circle is at the minimum end of the range, the broken circle indicating the maximum diameter for comparison; and FIG. 18 shows the use position of the component when its diameter indicated by the solid circle is at the maximum end of the range, the broken circle indicating the minimum diameter for comparison;

Reference numerals and characters appearing in more than one of the figures indicate the same or corresponding parts in each of them.

DETAILED DESCRIPTION

Figure 1:
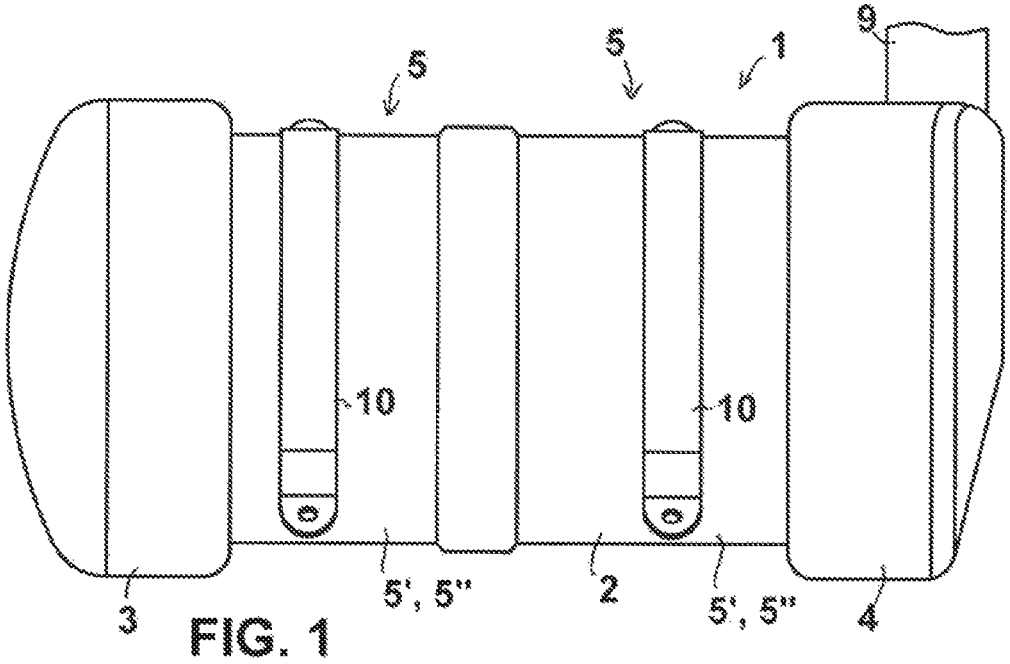
FIG. 1 is a front view of a component of an exhaust treatment system.

Referring to FIGS. 1-4, by way of example, a component 1 of an exhaust treatment system may comprise a generally cylindrical housing 2 closed at its axial ends by end caps 3, 4 and having two portions 5 of reduced diameter arranged in series along its length. Two cylindrical, permeable blocks 6 of ceramic material (one of which can be seen in cross-section in FIG. 3) may be fixed in compression, each within a layer 7 of compressible material, e.g. needle mat in a respective one of the two portions 5, to function for example as a particulate filter, catalytic converter, selective catalytic reductor or other exhaust treatment stage. Since each block 6 will typically vary in diameter, even between different blocks manufactured under identical conditions in the same batch, each portion 5 of the housing may be inwardly compressed or swaged to a slightly different diameter selected to correspond to the actual diameter of the individual block 6 contained within it. Similarly, each of several apparently identical components 1 may have portions 5 of different diameter.

In the illustrated example, an inlet 8 is connected to the left hand end cap 3 and an outlet 9 to the right hand end cap 4 so that the housing defines a flowpath via which the exhaust gas can flow from the inlet 8 through the blocks 6 and out through the outlet 9. Two mounting straps 10 are welded respectively to the outer surface 5' or 5" of the reduced diameter portions 5 of the housing.

Figure 2:
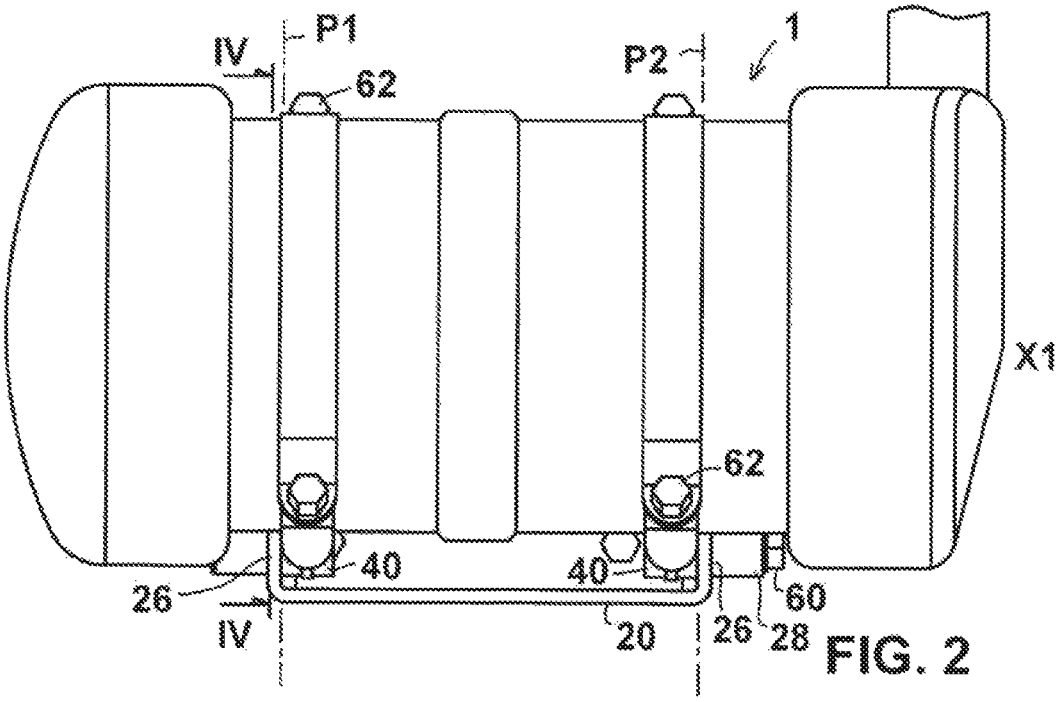
FIG. 2 shows the component in its use position in an assembly.
Figure 4:
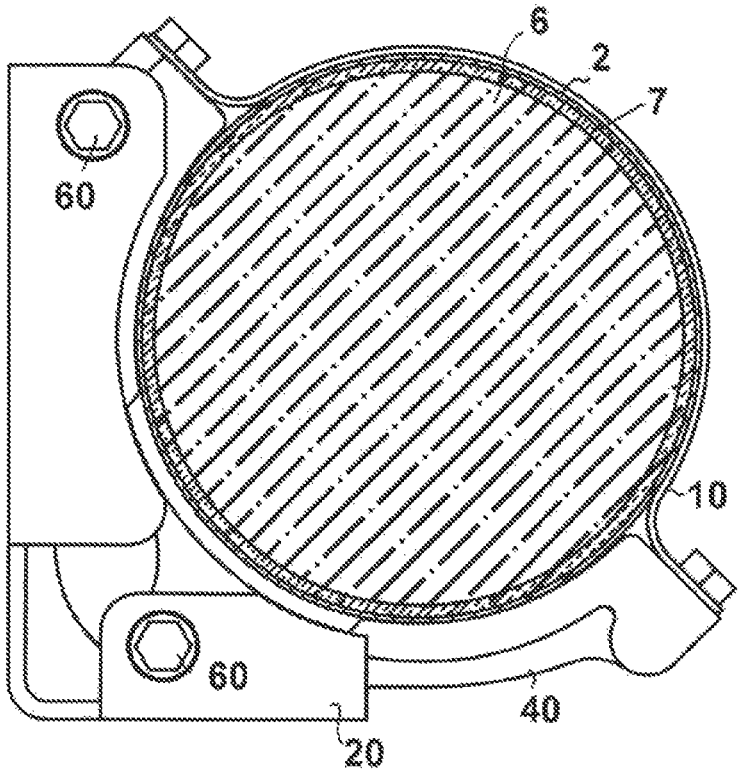
FIG. 4 is an end view of the mount with the component attached to both brackets in its use position as shown in FIG. 3, but with the component sectioned at IV-IV of FIG. 2.
Figure 3:
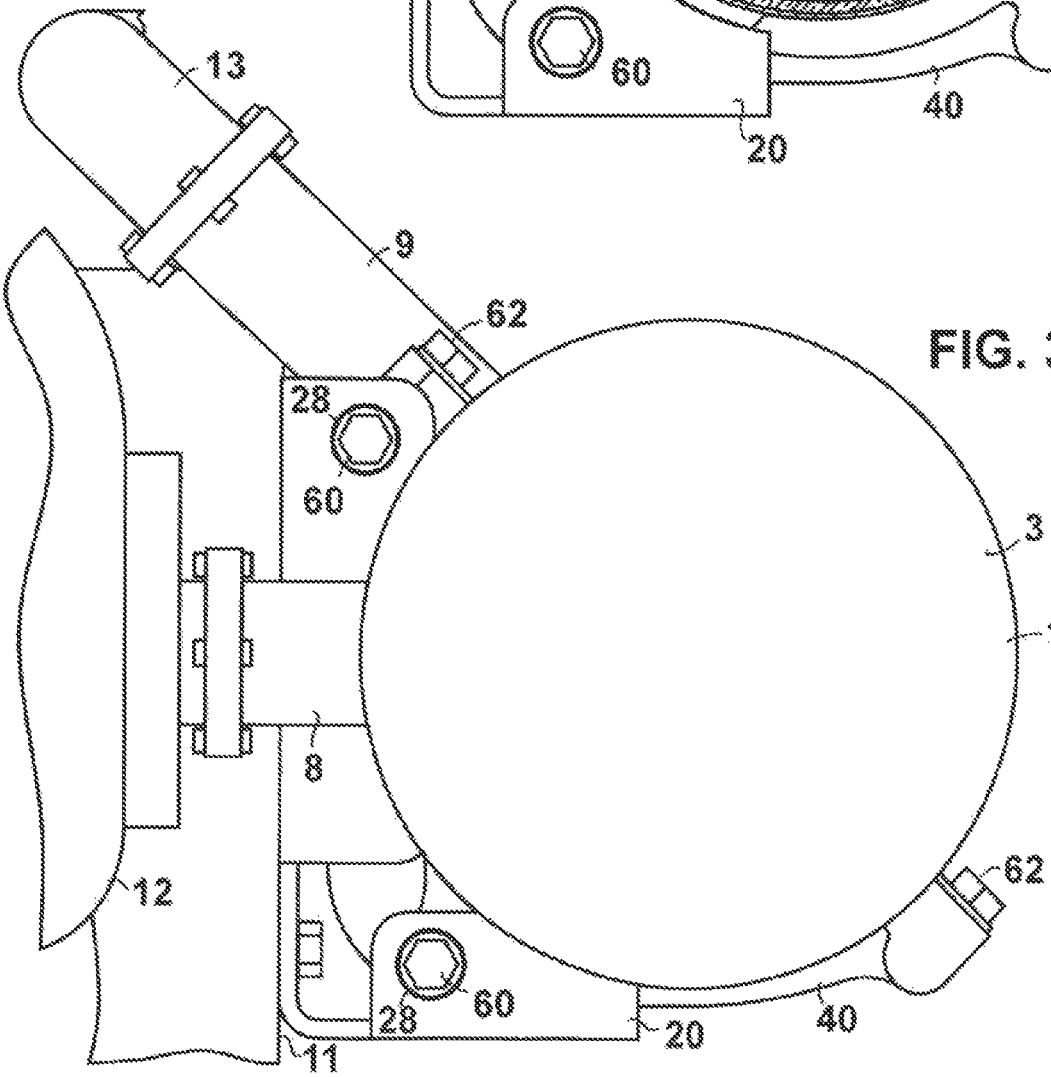
FIG. 3 is an end view of the assembly of FIG. 2, showing how the mount is attached to a support surface.

In use, the component 1 is mounted to a support surface 11, for example, a surface of the engine block or cylinder head of an internal combustion engine, by means of an assembly comprising a mount 20, two brackets 40, and two bracket fixings 60. In its use position as shown in FIGS. 2, 3 and 4 the inlet 8 may be connected to a supply of exhaust gas, for example, the outlet of a turbocharger 12 through which exhaust gas flows from the engine, and the outlet connected to a downstream component 13 such as another exhaust treatment stage or an emission pipe, to form part of an exhaust gas treatment system.

Figure 5:
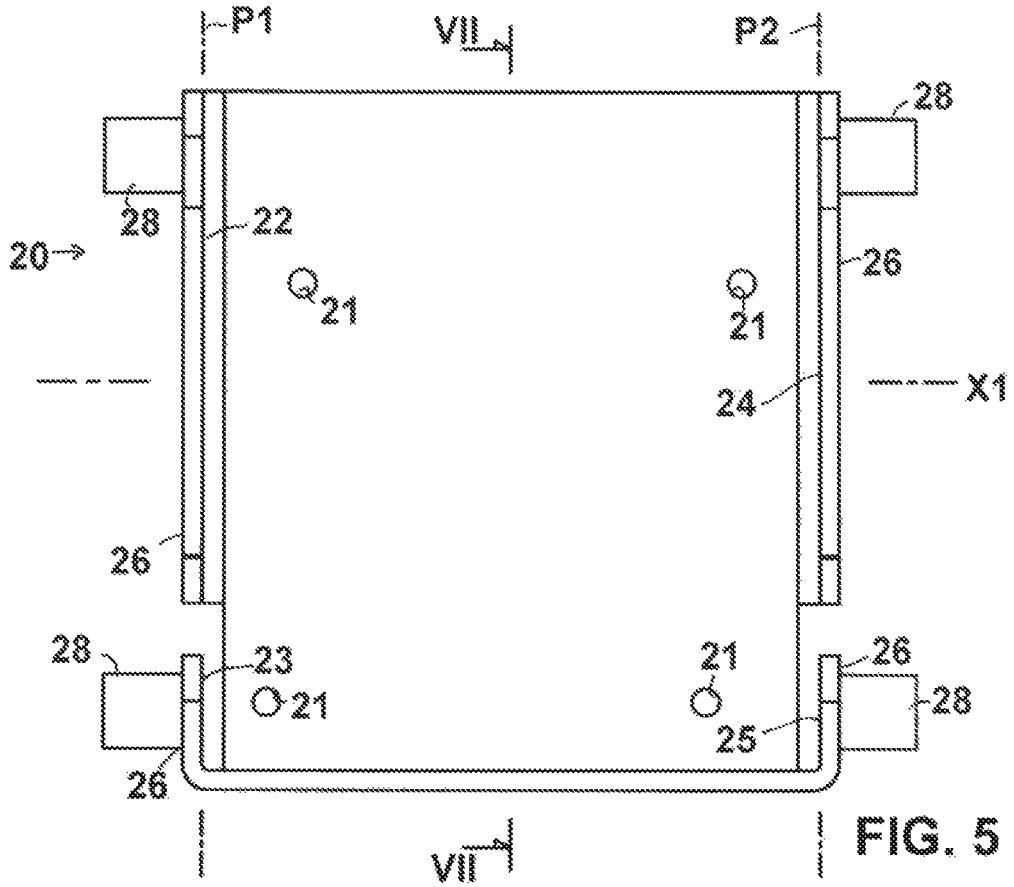
FIG. 5 is a front view of the mount.
Figure 6:
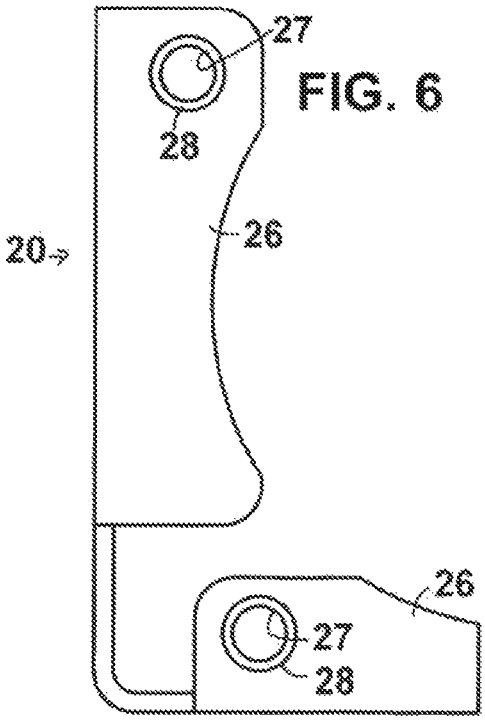
FIG. 6 is an end view of the mount.
Figure 7:
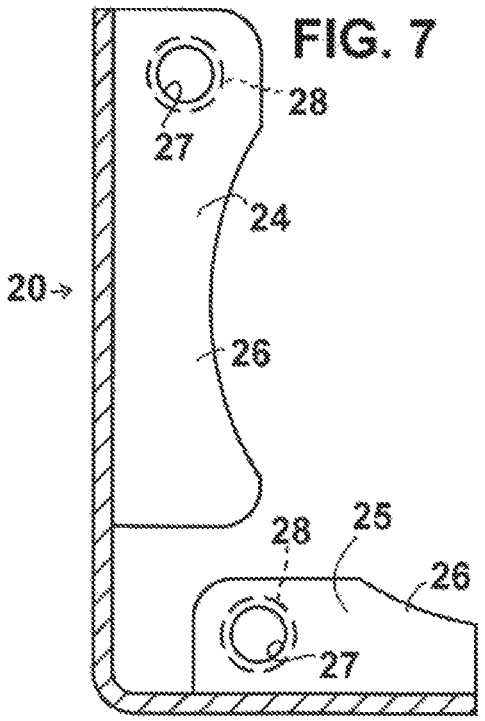
FIG. 7 is a section through the mount at VII-VII of FIG. 5.
Figure 11:
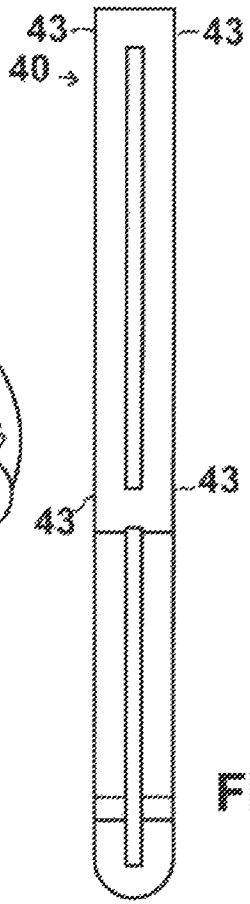
FIGS. 10 and 11 are respectively, front and rear views of the bracket.
Figure 9:
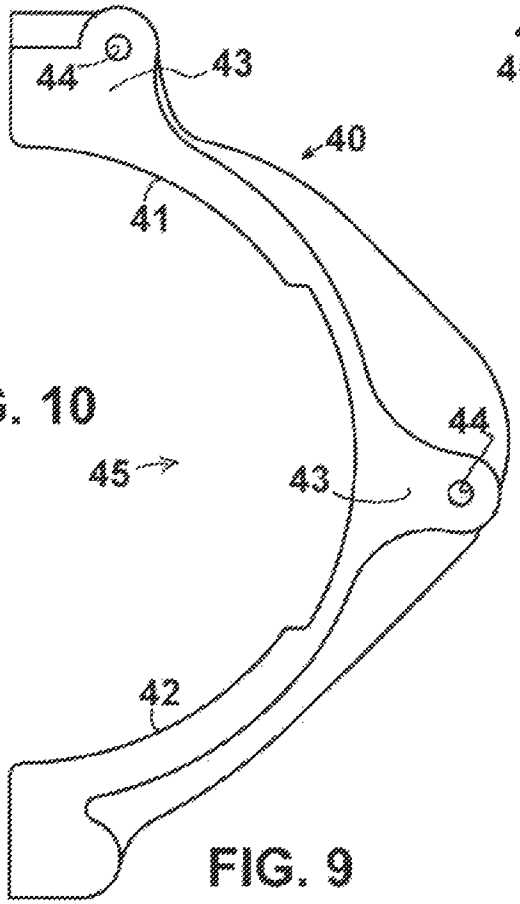
FIGS. 8 and 9 are respectively, left and right side views of one mounting bracket, hereinafter referred to simply as a bracket.
Figure 10:
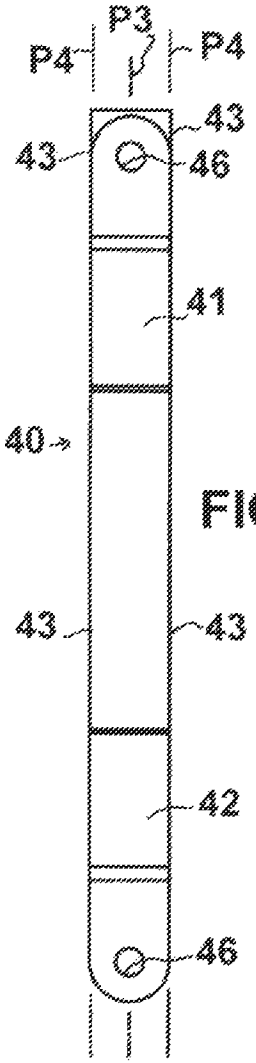
Figure 8:
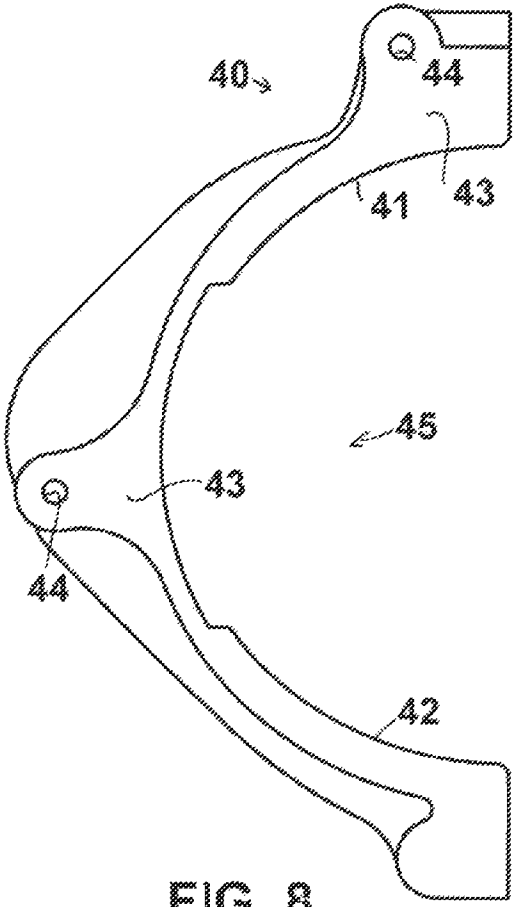

Referring also to FIGS. 5-7, the mount 20 may comprise a steel chassis having mounting holes 21 for fixings which attach it to the support surface 11. The chassis is pressed to form flanges 26 which define a first pair of upper and lower mounting surfaces 22, 23 and a second pair of upper and lower mounting surfaces 24, 25, each pair of mounting surfaces extending in a respective, common adjustment plane P1, P2 which is substantially normal (i.e. perpendicular) to a nominal length axis X1 of the mount. The two pairs of mounting surfaces, hence also the two adjustment planes, are arranged substantially in parallel and spaced apart along the length axis X1.

The length axis X1 extends in a general direction between the mounting surfaces and thus, in use, between the brackets 40 by which the component 1 is attached to the mount in its use position. It will be understood of course that the mount may have any shape consistent with its intended use situation, for example, to suit different engine configurations. In practice, small deviations from exact parallelism or perpendicularity are acceptable as long as the mounting surfaces permit adjustment of the two brackets to fix the component in its use position, as further described below.

In the illustrated example, the two pairs of mounting surfaces are arranged in opposed, facing relation, although they could alternatively face in the same direction or away from each other. Each mounting surface has a respective fixing hole 27 surrounded by a short, cylindrical collar 28 which extends away from the mounting surface on the opposite side of the respective flange 26.

Each bracket 40 is attachable to the support surface 11 (in the illustrated embodiment, via the pressed steel chassis of the mount) and configured for attachment of the component 1 to the bracket in a use position of the component, as will now be described.

Referring now to FIGS. 8-11, each bracket 40 is shaped to support the component 1 when the component is attached to the bracket in its use position as shown. Each bracket may consist essentially of a metal casting or forging, defining a recess 45 with two curved contact surfaces 41, 42 formed as machined surfaces, although it could be made in a different way if desired. The two ends of the bracket on either side of the recess are provided with threaded fixing holes 46 to receive component fixings 62 by which the mounting straps 10 can be fixed to the bracket to clamp the component 1 against the curved contact surfaces 41, 42 in its use position as further described below.

In the illustrated embodiment the brackets 40 are identical, each bracket being symmetrical about a central reference plane P3 which passes through the bracket. The opposite flat sides of the bracket define clamping surfaces 43 which lie respectively in two common clamping planes P4 extending in parallel with the reference plane P3 on each side of the bracket. Conveniently, this allows the bracket to be used on either side of the mount 20, although if preferred, only one clamping surface or clamping plane may be provided. Each clamping surface 43 is provided with a fixing hole 44 to receive a bracket fixing 60. In the illustrated embodiment the bracket fixings 60 are threaded screws or bolts, with the fixing holes 44 being smooth or threaded to engage the screws, although of course other fixings may be used if preferred.

Referring to FIG. 3, the use position of the component 1 may be rigidly constrained by its fluid connection to the upstream and downstream components 12 and 13 of the exhaust treatment system, while the position of the mount 20 is also fixed by its connection to the support surface 11. In order to compensate for small variations in the position and dimensions of the respective components, the position of each bracket may be adjusted to conform to the indeterminate use position of the component 1 as will now be described.

Optionally, each bracket fixing 60 may be arranged to be accessible and operable when the component 1 is attached to all of the brackets 40 in its use position. In the illustrated embodiment this is facilitated by the collars 28 which extend the position of the head of the bracket fixing 60 away from the respective flange 26 of the mount so that it is more easily accessible by a short tool inserted behind the end cap 3 or 4 of the component 1 in its use position, as best seen in FIG. 3.

During assembly, each bracket is arranged in a use orientation, as shown in FIGS. 2, 3 and 4 and FIGS. 12 and 13, with a respective one or pair of its clamping surfaces 43 in substantially parallel, opposed relation to a respective one or pair of the mounting surfaces 22, 23 or 24, 25 so that the reference plane P3 is substantially parallel with the respective adjustment plane P1 or P2. In their use orientation the two brackets 40 are configured for attachment of the component 1 to all of the brackets in its use position as shown in which the component 1 extends along the length axis X1 of the mount.

In one possible assembly procedure, the mount 20 may be fixed to the support surface 11 and the bracket fixings 60 engaged but left loose to retain the brackets 40 in their use orientation with the clamping surface 43 in parallel opposed relation to the respective mounting surface.

The component 1 may then be positioned in the recesses 45 of the brackets and fluidly connected to the upstream and downstream exhaust system components 12, 13 which define its use position.

Next, the component 1 may be attached and rigidly clamped to the bracket by component fixings 62 passing through the ends of its mounting straps 10 into the fixing holes 46 in the ends of the bracket. As the component fixings 62 are tightened they move each of the brackets 40 slidingly in the plane of its clamping surface 43 into its final clamping position.

Figure 12:
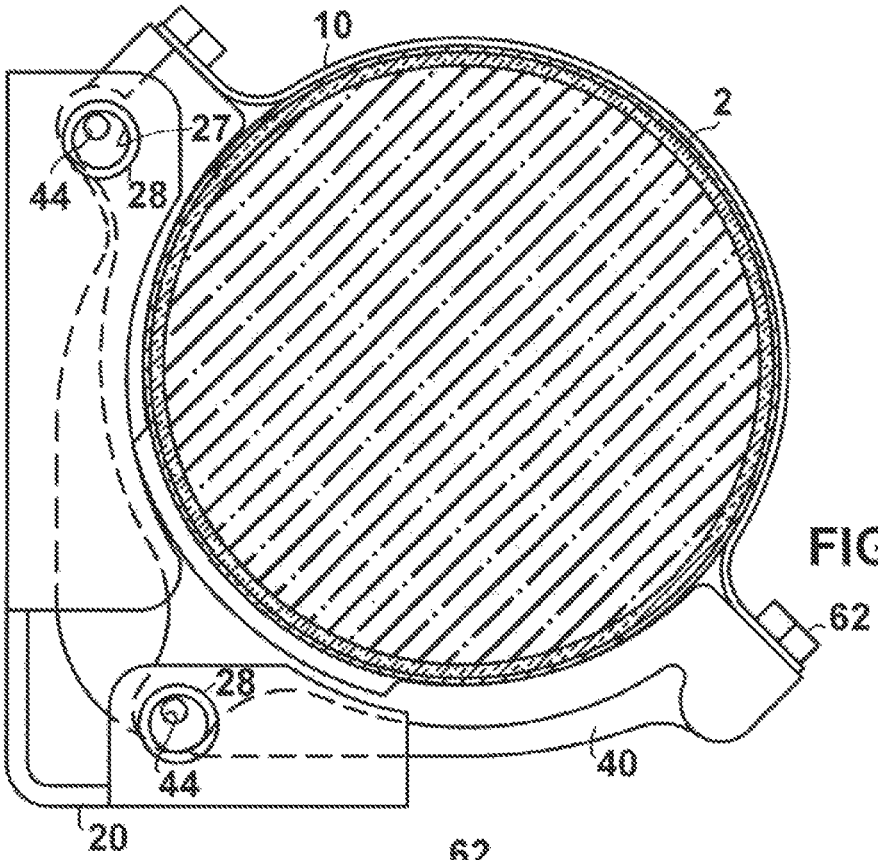
FIGS. 12 and 13 are views corresponding to FIG. 4, but with the bracket fixings removed to show how the bracket with the component attached in its use position can be moved in the adjustment plane between different clamping positions, represented respectively in the two figures.
Figure 13:
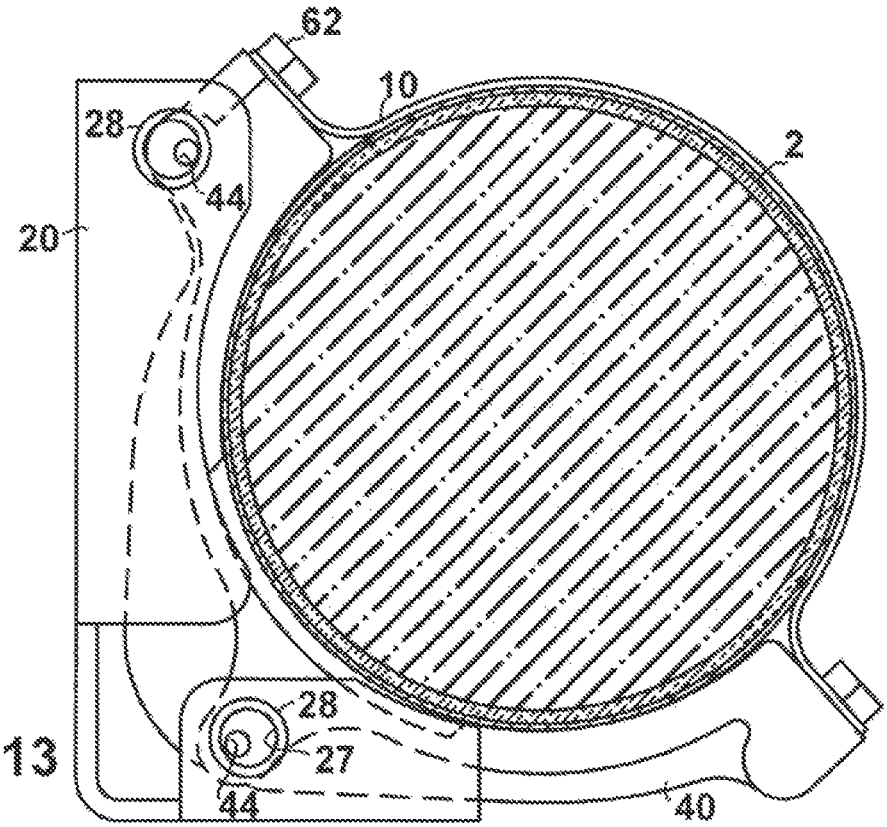

Referring to FIGS. 12 and 13, it can be seen that the fixing holes 27 and collars 28 have a larger diameter than the fixing holes 44 and bracket fixings 60, so that in its use orientation each bracket is adjustable, independently of the other respective bracket, by moving the position of the fixing holes 44 and bracket fixings 60 within the collars 28 and fixing holes 27 to define the selected clamping position. The clamping position is variable in any direction in the respective adjustment plane P1 or P2 as shown by the different clamping positions of FIG. 12 and FIG. 13.

Finally, each bracket fixing 60 may be operated (e.g. tightened) to operatively engage the clamping surface 43 of the respective bracket 40 with the respective opposed mounting surface 22, 23, 24 or 25 to fix the bracket to the mount 20 in the selected clamping position on the mounting surface.

The bracket fixings 60 may act in tension to obtain sufficient friction between the clamping surface 43 and the mounting surface to restrain the component 1 against movement by dynamic forces, for example, when mounted on a vehicle. The clamping surface 43 may directly engage the respective mounting surface or may be spaced from the mounting surface by a suitable sheet material or the like, for example, to increase friction between the facing surfaces.

Figure 14:
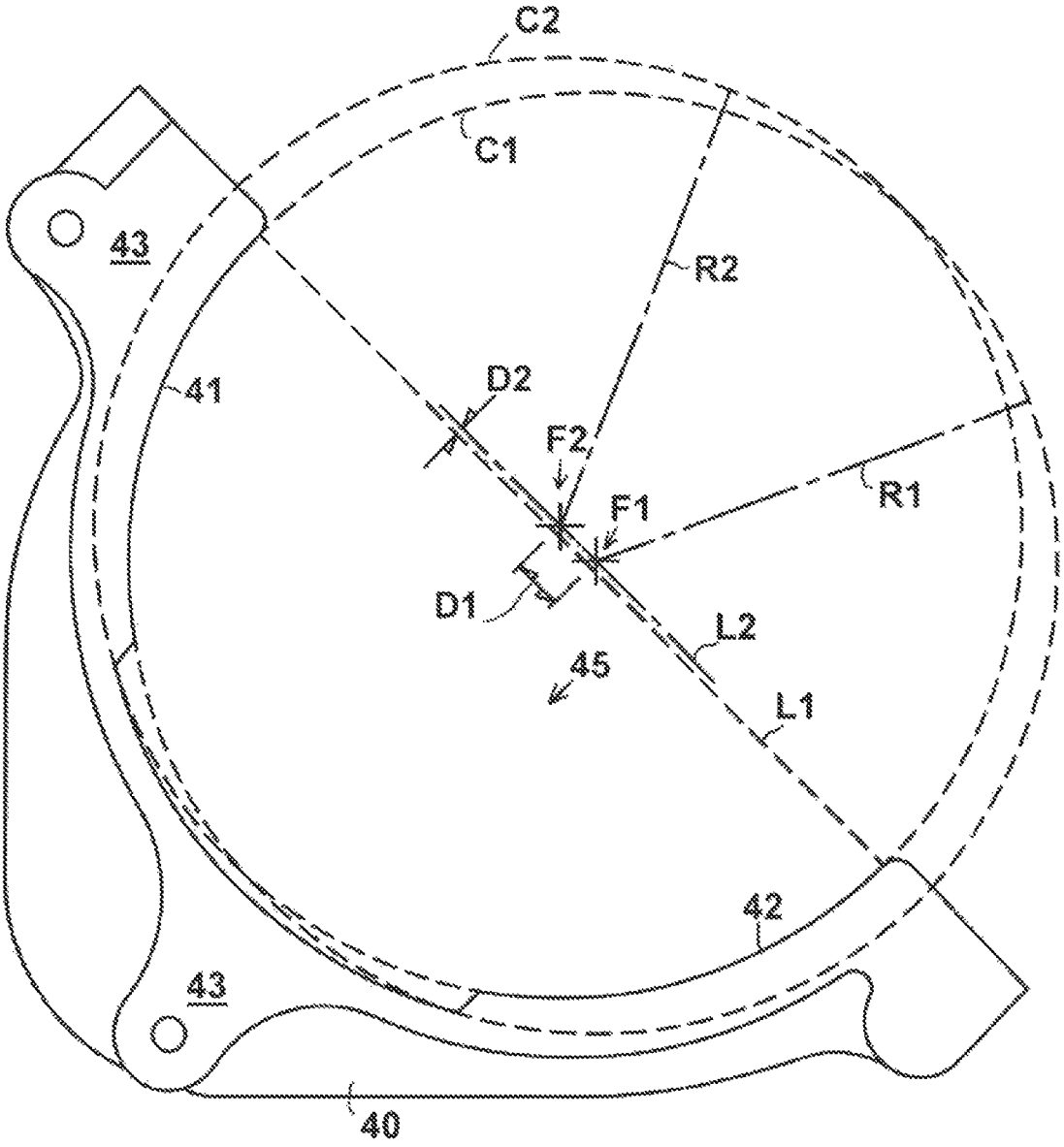
FIG. 14 is another left side view of the bracket, showing the geometry of the two curved contact surfaces in the reference plane.

Referring now to FIG. 14, the curved contact surfaces 41, 42 are arranged to engage the curved (typically, cylindrical) outer surface of the component 1 in its use position. When considered in the reference plane P3 as shown, each contact surface 41, 42 defines an arc of a respective circle C1, C2 spaced by a radius R1, R2 from a respective centre point F1, F2. The centre points F1, F2 of the respective circles C1, C2 are spaced apart in the reference plane P3 so that each arc is contained in the circle of the other respective arc; thus, the arc 41 defined by the circle C1 is contained within the circle C2 which defines the arc 42, and the arc 42 defined by the circle C2 is contained within the circle C1 defining the arc 41.

The radius R1, R2 of each circle may be selected to be somewhat greater than the radius of the curved surface of the component 1 which is clamped against the curved surfaces 41, 42 in its use position.

Referring to FIGS. 15-20, it is found that this geometric configuration allows the curved contact surfaces to contact a substantial portion of the curved surface of the component 1 in its use position, even where the diameter of the component is variable, for example, as a result of the typical assembly procedure for mounting a ceramic block inside the housing.

Figure 16:
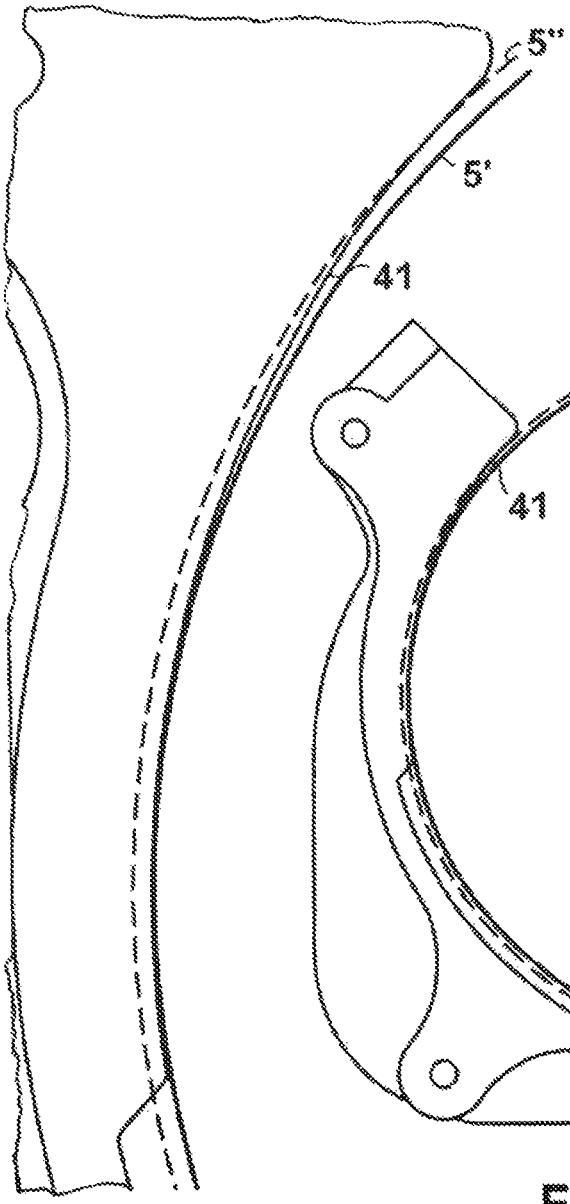
FIGS. 16 and 17 are enlarged fragmentary views, respectively of the upper and lower contact surfaces of FIG. 15.
Figure 15:
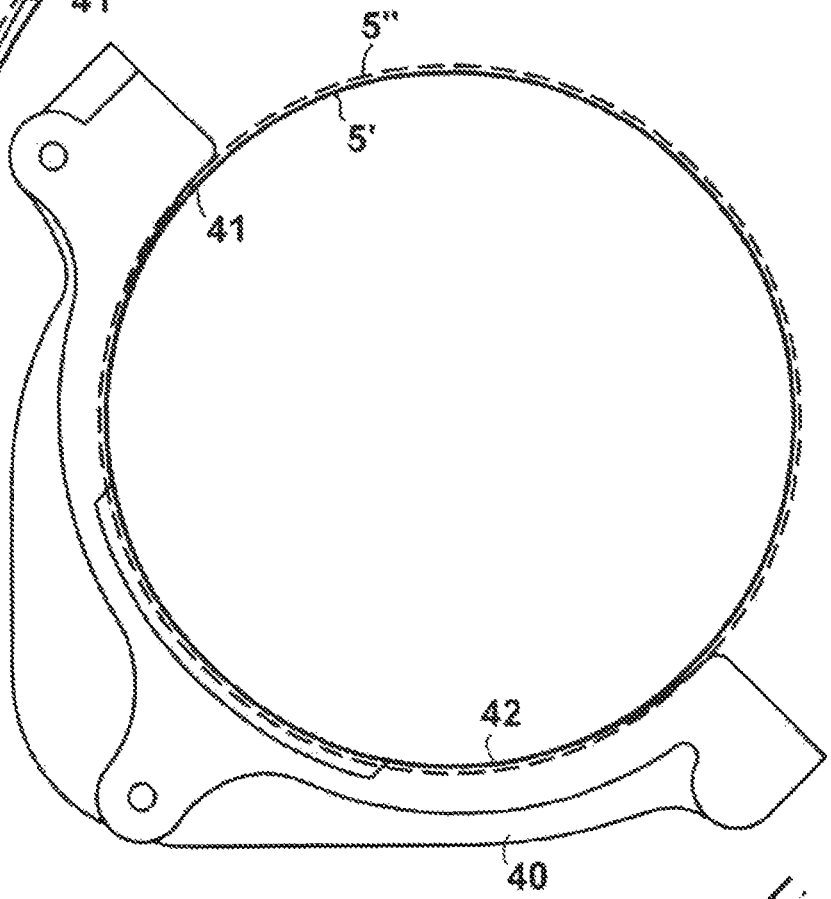
Figure 17:
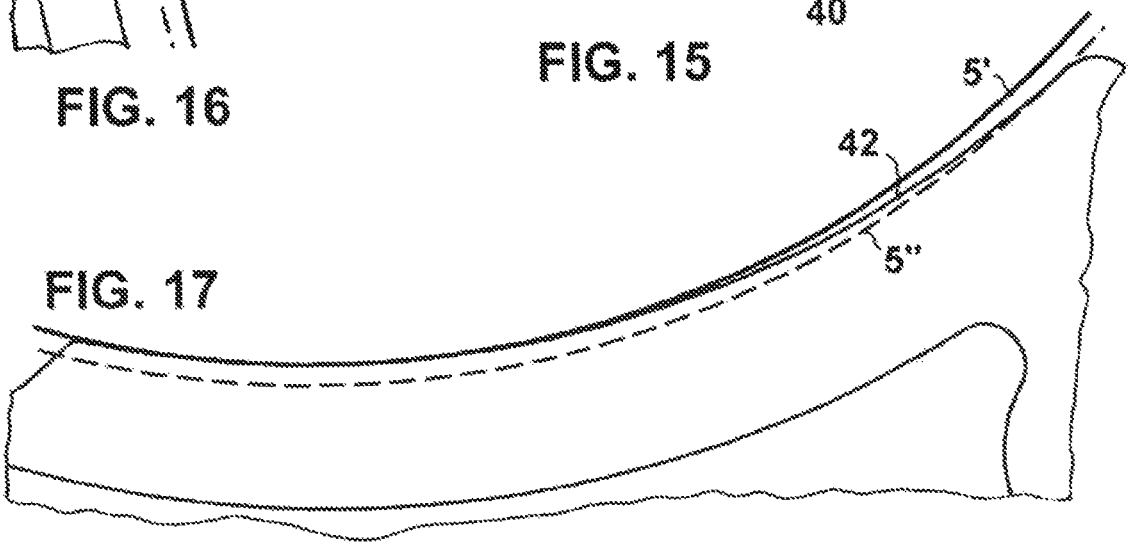
Figure 19:
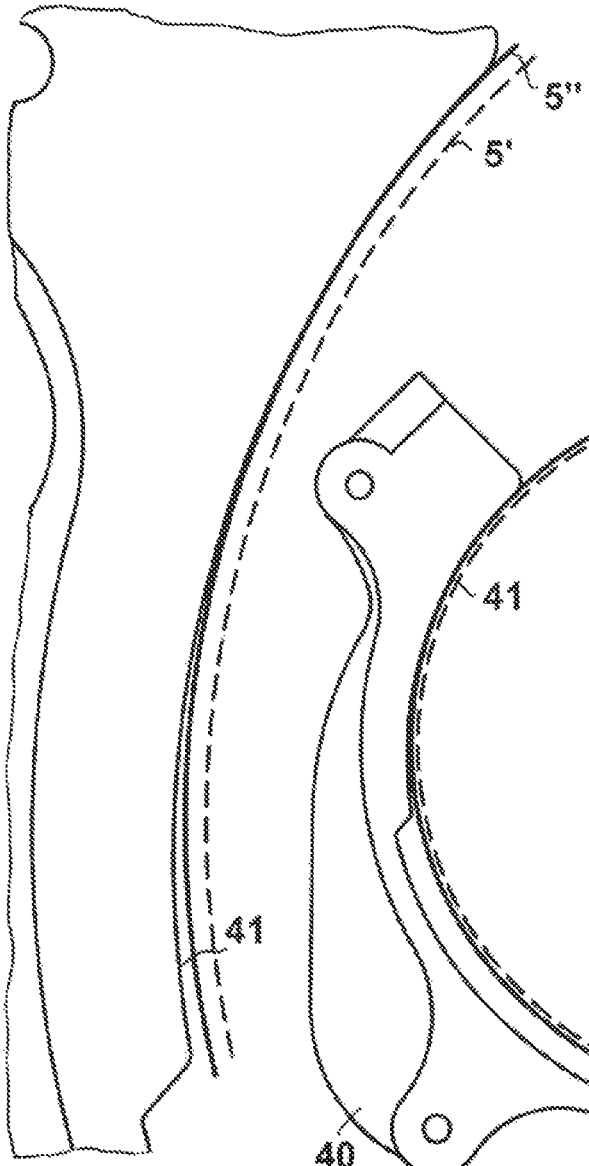
FIGS. 19 and 20 are enlarged fragmentary views, respectively of the upper and lower contact surfaces of FIG. 18.
Figure 18:
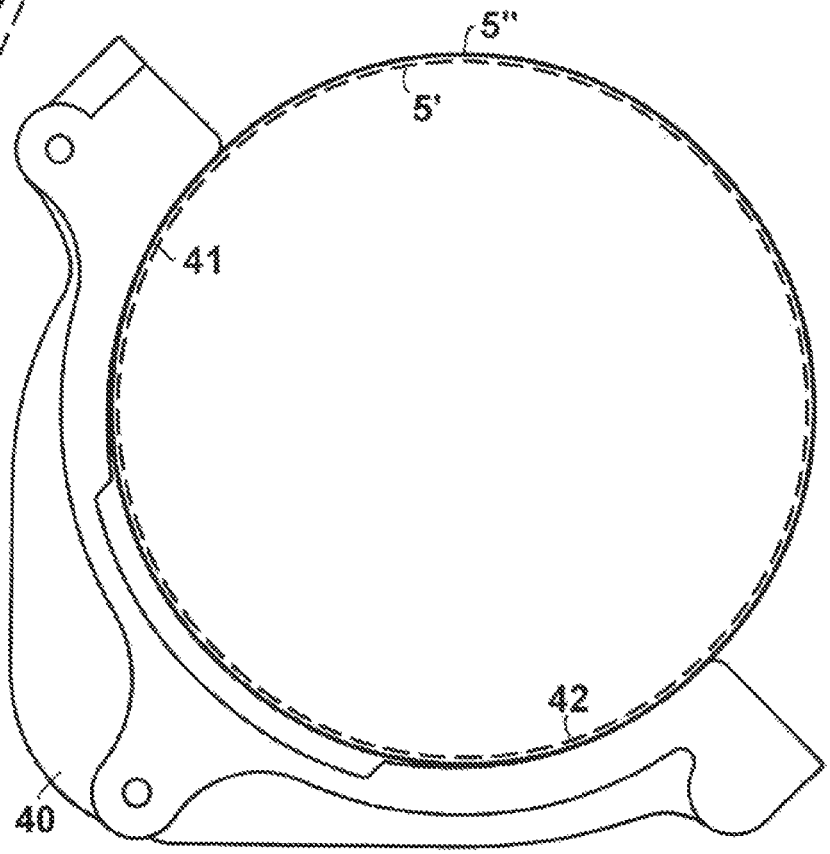
Figure 20:
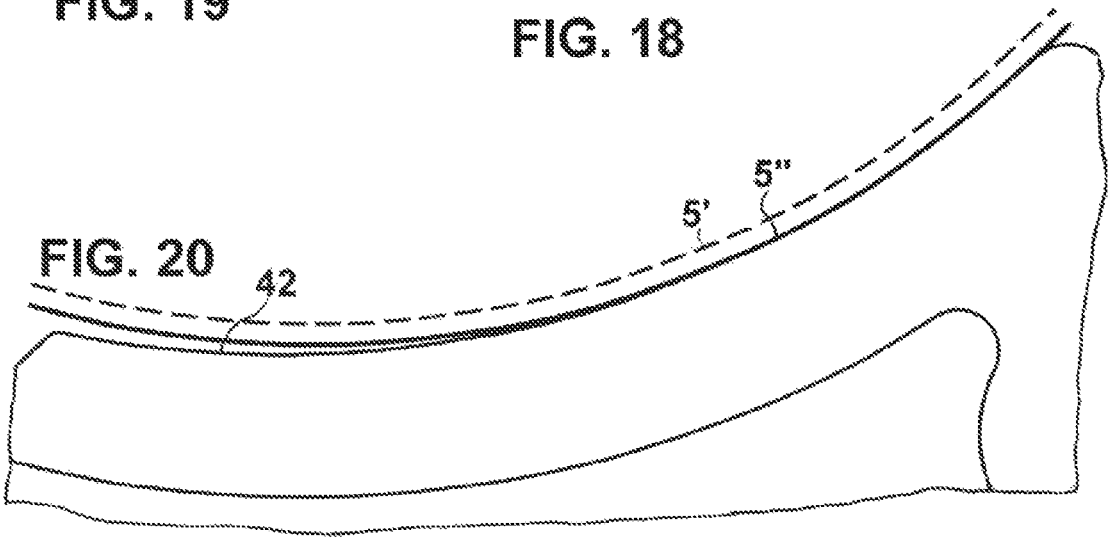

FIGS. 15-17 show how the curved surface 5' of the component 1 at the lower end of its diametric tolerance range engages each of the curved contact surfaces 41, 42 towards the inner side of the recess 45, whereas FIGS. 18-20 show how the curved surface 5" of the component 1 at the upper end of its diametric tolerance range engages each of the curved contact surfaces 41, 42 towards the outer side of the recess 45.

The configuration of the curved contact surfaces thus accommodates the variation in the component diameter with relatively little difference in the use position of the component between each of the extreme cases as shown. In practice, the ends of the mounting straps 10 may be sufficiently flexible to accommodate the small variation in the use position of the component while effectively clamping the component to the contact surfaces.

Referring again to FIG. 14, preferably the radius R1, R2 of each respective circle is from 95% to 105% of the radius of the other respective circle, and most preferably the radii R1, R2 are equal as shown. Further preferably, the respective centre points F1, F2 may be spaced apart by a distance D1 not less than 8% and not more than 13% of the radius R1, R2 of each of the circles, for example, about 10%-11% as also shown in FIG. 14. When configured in this way it is found that the contact surfaces conform particularly closely to the cylindrical curvature of a component housing of variable diameter smaller than that of the circles C1, C2.

Referring again to FIG. 14 it can be seen that when considered in the reference plane P3, the contact surfaces 41, 42 form opposite sides of the recess 45 which is bounded by an open side through which in use the component 1 may be introduced into the recess. The open side may be defined as a straight line L1 at which both contact surfaces 41, 42 terminate. Preferably as shown, the centre points F1, F2 are spaced apart along a straight reference line L2 collinear or substantially parallel with the open side L1.

Preferably the reference line L2 is arranged outwardly of the recess 45 with respect to the open side L1, as shown. In this case, further preferably, the reference line L2 and the open side L1 may be spaced apart by a distance D2 of not more than 4% of the radius R1, R2 of each of the circles C1, C2, as shown. Most preferably, the distance D2 between the reference line L2 and the open side L1 may be about 2.5%-3.5% of the radius R1, R2 of each of the circles C1, C2.

Again, when configured in this way it is found that the contact surfaces conform particularly closely to the cylindrical curvature of a component housing of variable diameter smaller than that of the circles C1, C2.

INDUSTRIAL APPLICABILITY

The novel assembly may be used to attach an exhaust treatment component to a support surface, for example, on an engine or in another use situation, in a use position which is determined by its fluid connections to the upstream and downstream components of the exhaust treatment system and not by the predetermined fixed position of the mount or the brackets. The configuration of the brackets makes it easy to adjust the brackets in any required direction in the adjustment plane P1, P2 to conform to the use position of the component. The brackets may then be clamped to the mounting surfaces to fix the component in its use position against dynamic forces which it may experience in use.

The brackets accommodate dimensional variations in the contact surface 5', 5" of the housing so that the component is supported over a substantial part of its surface area with minimal flexure of the housing, irrespective of its actual diameter within its dimensional tolerance range, and with little difference in the use position of the component.

When the brackets are used in the novel assembly, even the small difference in the use position of the component 1 in the brackets at each the extremities of its dimensional tolerance range can be accommodated by movement of the brackets relative to the mount, as can other variations in the dimensions and positions of the remaining components of the exhaust treatment assembly and support surface.

Finally, by providing for the clamping position of each of the brackets to move in any required direction in the adjustment plane while the bracket is loosely connected to the mounting surface in its use orientation, and by making it possible to fix each of the brackets in its final clamping position after arranging the component 1 in its use position, it is possible to install the complete assembly without measuring or predefining the bracket positions, which are defined simply by attaching the component 1 to the brackets. Since each bracket is independently adjustable, the use position of the component may vary both in translation and in rotation in multiple directions as dictated by its use environment, so that rigid fluid connections can be used instead of more bulky, flexible fluid connections.

In summary, an exhaust treatment component may be mounted in brackets, each bracket having a clamping surface which in a use orientation is arranged in parallel with a corresponding mounting surface of a fixed mount, the mounting surfaces defining adjustment planes which are spaced apart along a length axis of the mount. Each bracket may be adjusted independently in its use orientation to define a variable clamping position in the adjustment plane. In another aspect, the component may be mounted in one or more brackets, each bracket comprising curved contact surfaces, each surface being defined by an arc of a respective circle, each arc being contained in the circle of the other respective arc. The component can be clamped to the bracket irrespective of its diameter. The brackets may be assembled to the mount to mount a component of indeterminate diameter in an indeterminate mounting position which is variable in both rotation and translation in multiple directions.

In alternative embodiments the assembly may comprise more than two brackets and mounting surfaces. The mounting surfaces need not be arranged in pairs; each mounting surface could have alternative fixing arrangements, for example, a single hole, more than two holes, or any suitable surface cooperating with the bracket fixings. The clamping surfaces and mounting surfaces could be coated or textured, e.g. serrated or knurled, to provide an enhanced friction connection. Instead of a threaded fastening or fastenings, each of the bracket fixings might comprise one or more clamps or any other suitable arrangement for engaging the bracket with the respective mounting surface. Instead of the fixing holes 46, the brackets may have any suitable shape or features to facilitate the attachment of the component 1 in its use position.

The brackets may have any suitable shape within the scope of the claims. In embodiments where the brackets are used without the mount, the brackets may be configured with any suitable mounting holes, flanges or other surfaces or features to facilitate the direct or indirect attachment of the brackets to a support surface.

Many further possible adaptations are possible within the scope of the claims.

In the claims, reference characters and numerals are provided in parentheses for ease of reference, and should not be construed as limiting features.

The invention claimed is:

1. An assembly for mounting a component of an exhaust treatment system to a support surface, the assembly including:

a mount, the mount being attachable to the support surface;

at least two brackets; and at least two bracket fixings;

the mount defining at least two, substantially parallel mounting surfaces, the mounting surfaces being spaced apart along a length axis of the mount, each mounting surface extending in a respective adjustment plane substantially normal to the length axis;

each bracket having a respective clamping surface, each bracket being arranged in a use orientation with the respective clamping surface in opposed relation to a respective one of the mounting surfaces;

the brackets being configured for attachment of the component to all of the brackets in a use position wherein the component extends along the length axis;

each bracket being independently adjustable in its use orientation to define a selected clamping position, the clamping position being variable in any direction in the respective adjustment plane;

each bracket fixing being operable to operatively engage the clamping surface of a respective one of the brackets with the respective opposed mounting surface to fix the bracket to the mount in the selected clamping position, wherein, in a reference plane passing through the bracket, the bracket comprises two curved contact surfaces, the contact surfaces being arranged to engage a curved outer surface of the component in its use position;

and each contact surface defines an arc of a respective circle spaced by a radius from a respective centre point, and the centre points of the respective circles are spaced apart in the reference plane so that each arc is contained in the circle of the other respective arc.

2. An assembly according to claim 1, wherein each bracket fixing is arranged to be accessible and operable when the component is attached to all of the brackets in its use position.

3. An assembly according to claim 1 wherein the reference plane is substantially parallel with the respective adjustment plane.

4. A mounting bracket for mounting a component of an exhaust treatment system to a support surface, the bracket being attachable to the support surface and configured for attachment of the component to the bracket in a use position of the component;

wherein, when considered in a reference plane passing through the bracket, the bracket comprises two curved contact surfaces, the contact surfaces being arranged to engage a curved outer surface of the component in its use position;

and each contact surface defines an arc of a respective circle spaced by a radius from a respective centre point, and the centre points of the respective circles are spaced apart in the reference plane so that each arc is contained in the circle of the other respective arc.

5. A mounting bracket according to claim 4, wherein the radius of each respective circle is from 95% to 105% of the radius of the other respective circle.

6. A mounting bracket according to claim 5, wherein the centre points are spaced apart by a distance not less than 8% and not more than 13% of the radius of each of the circles.

7. A mounting bracket according to claim 4, wherein when considered in the reference plane, the contact surfaces form opposite sides of a recess bounded by an open side through which in use the component may be introduced into the recess, the open side being defined as a straight line at which both contact surfaces terminate;

and the centre points are spaced apart along a straight reference line collinear or substantially parallel with the open side.

8. An assembly according to claim 7, wherein the reference line is arranged outwardly of the recess with respect to the open side.

* * * * *